US009950906B2

(12) United States Patent
Ramsey et al.

(10) Patent No.: US 9,950,906 B2
(45) Date of Patent: Apr. 24, 2018

(54) ROLL LIFTING ASSEMBLIES, SYSTEMS, AND METHODS

(71) Applicant: BUILDING MATERIALS INVESTMENT CORPORATION, Wilmington, DE (US)

(72) Inventors: John A. Ramsey, Richmond Hill, GA (US); Jason N. Knapp, Savannah, GA (US)

(73) Assignee: Building Materials Investment Corporation, Dallas, TX (US)

( * ) Notice: Subject to any disclaimer, the term of this patent is extended or adjusted under 35 U.S.C. 154(b) by 416 days.

(21) Appl. No.: 14/204,695

(22) Filed: Mar. 11, 2014

(65) Prior Publication Data

US 2014/0263139 A1 Sep. 18, 2014

Related U.S. Application Data

(60) Provisional application No. 61/779,924, filed on Mar. 13, 2013.

(51) Int. Cl.
*B66C 1/56* (2006.01)
*B66C 1/22* (2006.01)

(52) U.S. Cl.
CPC . *B66C 1/56* (2013.01); *B66C 1/22* (2013.01)

(58) Field of Classification Search
CPC .... B66C 1/22; B66C 1/54; B66C 1/56; B66C 1/42; B66C 1/48; B66C 1/485; B66C 1/66
See application file for complete search history.

(56) References Cited

U.S. PATENT DOCUMENTS

| | | | | |
|---|---|---|---|---|
| 2,634,156 A * | 4/1953 | Crimmel | B66C 1/54 | 294/110.2 |
| 2,951,725 A * | 9/1960 | St Jean | B66C 1/32 | 294/106 |
| 2,987,339 A * | 6/1961 | Kaplan | B66C 1/24 | 294/67.2 |
| 3,744,836 A * | 7/1973 | Goettl | B66C 1/54 | 294/119.2 |
| 4,136,903 A * | 1/1979 | Roethler | B29D 30/0016 | 294/81.61 |
| 4,430,040 A | 2/1984 | Halmos | | |
| 5,088,654 A * | 2/1992 | Cielker | B66F 3/24 | 242/591 |
| 5,174,710 A | 12/1992 | Dragos et al. | | |
| 5,468,116 A | 11/1995 | Reichert et al. | | |

(Continued)

OTHER PUBLICATIONS

"Rol-handIR Model PH1 Portable Hoist Roll Handling Systems," Roll Lifting Devices, CAC Products at http://www.converteraccessory.com/products/roll_lifting/main%20without%20manual%20and%20motorized%20PH1.html (Jan. 25, 2013 9:58:10 PM).

(Continued)

*Primary Examiner* — Anna M Momper
*Assistant Examiner* — Ashley K Romano
(74) *Attorney, Agent, or Firm* — Baker & McKenzie LLP

(57) ABSTRACT

The present disclosure relates, according to some embodiments, to roll lifting assemblies, systems, and methods for lifting, handling, and/or maneuvering rolled material. According to some embodiments, a roll lifting system may be configured to move a single roll and/or to concurrently move two or more rolls. For example, a roll lifting system may comprise a translocation apparatus and/or a lift assembly.

20 Claims, 11 Drawing Sheets

(56) References Cited

U.S. PATENT DOCUMENTS

| | | | | |
|---|---|---|---|---|
| 5,642,979 | A | 7/1997 | Cullen et al. | |
| 6,022,183 | A | 2/2000 | Walters et al. | |
| 6,032,998 | A * | 3/2000 | Damour | B66C 1/54 294/67.5 |
| 2013/0088027 | A1 * | 4/2013 | Eastall | B66C 1/485 294/67.2 |

OTHER PUBLICATIONS

"Model 82NC—Narrow Coil 'C' Hook," Hoists Direct Inc. at http://www.hoistsdirect.com/Caldwell%20Coil%20Lifters.htm (Jan. 25, 2013 9:50:14 PM).
"Compac Mk5 LiftingRange," Packline at http://www.packline.co.uk/res/Compac%20Variations%20-%20Reels%20and%20drums.log.pdf.
"Cynergy Ergonomics Case Studies Ergonomic Material Handling Devices at Work," Cynergy Ergonomics at http://www.cynergyergonomics.com/case-studies/manual-roll-handling-carts.html.
"R-2000iB Series," Fanuc Robotics at http://www.fanucrobotics.com/cmsmedia/datasheets/R-2000iB%20Series_29.pdf (2009).
"Heavy Duty Lifting Range," Packline at http://www.packline.co.uk/res/Heavy%20Duty%20Lifting%20Variations%20-%20Reels%20and%20Drums.pdf.
"Images of Morse Drum Spotter/Drum Palletizer—Model 81," Morse at http://morsedrum.com/products/81-drum-palletizer-image.htm (Jan. 27, 2013 5:24:58 PM).
"Palettizing installation," ATF Automations at http://www.atfsrl.com/file/documenti/pdf/macchine/LOGIK%20GB%20DE.pdf.
"Roll Palletizing," Reichel & Drews at http://reicheldrews.com/production-systems-machines/low-slope-production/roll-palletizing/ (Nov. 27, 2013 10:37:41 PM).
"Vertical Spool Lifters," Tilt-Lock at http://www.tiltlock.com/spoollifters.htm.
"Making Work Faster, Safer, and Easier with Lifting, Positioning and Transporting Products," Southworth at http://www.southworthproducts.com/stuff/contentmgr/files/5a31cf85e82c1b611c93b92e5956dfb3/misc/sw_full_line_brochure_lroct152012.pdf (2012).
"Vertical Centerlifts," Tilt-Lock at http://www.tiltlock.com/centerlifts.htm (2005).
First Official Action dated Nov. 6, 2017 in connection with Mexican Application No. MX/a/2014/003045, 5 pages.

* cited by examiner

ROLL LIFTING ASSEMBLIES, SYSTEMS, AND METHODS

CROSS-REFERENCE TO RELATED APPLICATIONS

This application claims priority to U.S. Provisional Application No. 61/779,924 filed Mar. 13, 2013, the contents of which are hereby incorporated in their entirety by reference.

FIELD OF THE DISCLOSURE

The present disclosure relates, in some embodiments, to roll lifting assemblies, systems, and methods.

BACKGROUND

Currently, palletizing modified bitumen finished product rolls incorporates an end effecter probe and clamp assembly mounted to an arm on a gantry robot. The robot inserts a probe into a vertically standing modified bitumen finished product roll. The assembly squeezes the roll between the clamp located on the outside of the roll and the inserted probe permitting the roll to be picked up and transferred to a pallet. The squeezing action forces sand on the back of the sheet to be pressed deeply into the asphalt causing it to bleed onto the front or granule side of the sheet where the back surface contacts the front in a wound roll.

SUMMARY

Accordingly, a need has arisen for improved roll lifting assemblies, systems, and methods. For example, a need has arisen for roll lifting assemblies capable of manipulating rolls without applying squeezing forces and/or leaving the roll less damaged or substantially undamaged.

The present disclosure relates, according to some embodiments, to roll lifting assemblies, systems, and methods for lifting, handling, and/or maneuvering rolled material. While the present disclosure employs modified bitumen finished product rolls as an illustrative rolled material, those of ordinary skill in the art having the benefit of the instant disclosure will recognize the many other types of rolled material that could be similarly manipulated.

According to some embodiments, a roll lifting system may be configured to move a single roll and/or to concurrently move two or more rolls. For example, a roll lifting system may comprise a translocation apparatus and/or a lift assembly. A translocation apparatus may comprise a fixed beam having a longitudinal axis and/or an arm having a longitudinal axis and operable to move relative to the beam in a plane defined by the longitudinal axes of the beam and the arm. A lift assembly, in some embodiments, may be mounted to the translocation apparatus at a first end of the arm. A lift assembly may comprise (a) a generally elongated frame having an upper end and a lower end and side by side first and second portions, (b) a first probe moveably connected at the upper end of the first portion of the frame, (c) a first foot moveably connected at the lower end of the first portion of the frame, (d) a first guide moveably connected at a first portion of the frame between its upper end and its lower end, (e) a second probe moveably connected at the upper end of the second portion of the frame, (f) a second foot moveably connected at the lower end of the second portion of the frame, and/or (g) a second guide moveably connected at a second portion of the frame between its upper end and its lower end, in some embodiments. A first probe, foot, and/or guide may be configured to contact a first roll and/or the first foot is configured to bear more than half (e.g., substantially all) of the weight of the first roll. A second probe, foot, and/or guide may be configured to contact a second roll and/or the second foot is configured to bear more than half (e.g., substantially all) of the weight of the second roll. According to some embodiments, a first roll and/or a second roll may have a hollow core. A first probe and/or a second probe may be configured for at least partial insertion into at least a portion of a hollow core of a first and/or second roll. A first foot may be configured to reversibly slide under a portion of the lower end of a first roll, in some embodiments. Likewise, a second foot may be configured to reversibly slide under a portion of the lower end of a second roll, in some embodiments. A first guide and/or a second guide may be configured (e.g., positioned along the length of the frame) to contact the lower half, lower third, or lower quarter of the respective first roll and/or second roll in some embodiments. A lift assembly may be configured to receive and/or maintain each of the first roll and the second roll in a vertical or substantially vertical position (e.g., throughout translocation), according to some embodiments.

According to some embodiments, the present disclosure relates to methods for moving rolls (e.g., vertically standing rolls) with a lift system comprising a translocation apparatus and a lift assembly. A method may comprise, for example, (a) contacting at least a portion of a first probe with at least a portion of a hollow core nearest the upper end of a first roll, (b) contacting at least a portion of a second probe with at least a portion of a hollow core nearest the upper end of a second roll, (c) contacting at least a portion of a first foot with at least a portion of the lower end of the first roll, (d) contacting at least a portion of a second foot with at least a portion of the lower end of the second roll, (e) ambulating the lift assembly from a first position to a second position via the translocation apparatus, (f) contacting at least a portion of a first guide with at least a portion of the first roll, (g) contacting at least a portion of a second guide with at least a portion of the second roll, (h) disengaging the first foot from the lower end of the first roll, (i) disengaging the second foot from the lower end of the second roll, (j) disengaging the first probe from the upper end of the first roll; and/or (k) disengaging the second probe from the upper end of the second roll. A method may include, in some embodiments, continuously or substantially continuously maintaining a roll (e.g., a first roll and/or a second roll) in a generally vertical position. Rolls may be kept and/or stabilized in a vertical and/or substantially vertical position in some embodiments. For example, a method may include partially disengaging a first probe from the upper end of a first roll, confirming the first roll is at rest in a generally vertical position, and/or completing disengagement of the first probe from the upper end of the first roll. A method may include, for example, partially disengaging the second probe from the upper end of the second roll, confirming the second roll is at rest in a generally vertical position, and/or completing disengagement of the second probe from the upper end of the second roll. In some embodiments, ambulating the lift assembly from a first position to a second position via the translocation apparatus may further comprise suspending the first roll and the second roll no more than about one inch above the second position. Upon retraction of a first foot and/or a second foot, a first roll and/or a second roll may descend or move downward no more than about an inch. According to some embodiments, supporting all or substantially all of the weight of a roll may contribute to preserving the condition of a roll from position to position.

BRIEF DESCRIPTION OF THE DRAWINGS

Some embodiments of the disclosure may be understood by referring, in part, to the present disclosure and the accompanying drawings, wherein.

Figure 1A:
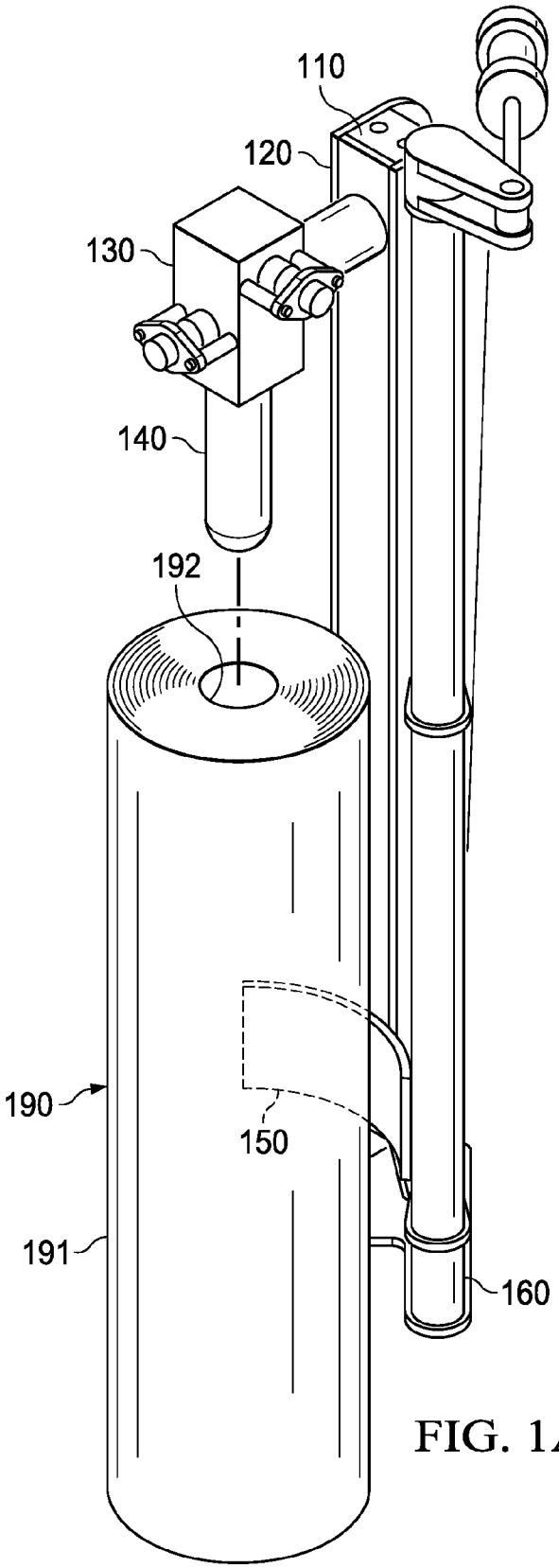
FIG. 1A illustrates a perspective view of a roll lifting apparatus approaching a roll according to a specific example embodiment of the disclosure.

Table 1 below includes the reference numerals used in this application. The thousands and hundreds digits correspond to the figure in which each item appears while the tens and ones digits correspond to the particular item indicated. Similar structures share matching tens and ones digits.

| | FIG. 1 | FIG. 2 | FIG. 3 | FIG. 4 |
|---|---|---|---|---|
| System | | | | 400 |
| Gantry | | | | 401 |
| Gantry motor | | | | 402 |
| Gantry arm | | | | 403 |
| Gantry beam | | | | 404 |
| Roll lifting assembly | 105 | | | 405 |
| Lift mount | 110 | 210 | 310 | |
| Frame | 120 | 220 | 320 | |
| Boss | | 221 | 321 | |
| Frame portion | | | 322 | |
| Frame portion | | | 323 | |
| Probe mount | 130 | 230 | 330 | |
| Slide | | | 331 | |

-continued

| | FIG. 1 | FIG. 2 | FIG. 3 | FIG. 4 |
|---|---|---|---|---|
| Slide | | | 332 | |
| Probe | 140 | | 340 | |
| Guide | 150 | 250 | 350 | |
| Arm | 151 | 251 | | |
| Foot mount | 160 | 260 | 360 | |
| Connector | | 261 | 361 | |
| Connector | | 262 | | |
| Piston | | 263 | | |
| Foot 170 | 170 | 270 | 370 | |
| Roll | 190 | 290 | | |
| Roll body | 191 | 291 | | |
| Roll aperture | 192 | 292 | | |

DETAILED DESCRIPTION

The present disclosure relates, in some embodiments, to lifting assemblies, systems, and methods for maneuvering (e.g., vertically maneuvering) a rolled material. A lifting assembly may include a frame, a probe connected (e.g., fixedly or moveably connected) to the frame, a guide connected (e.g., fixedly or moveably connected) to the frame, and/or a foot connected (e.g., fixedly or moveably connected) to the frame. A frame, probe, and foot may have any desired form and comprise any material suitable for moving a chosen roll or rolled material. One of ordinary skill in the art having the benefit of the present disclosure will appreciate that various combinations of fixed and moveable components are possible. For example, a probe could be fixed in relation to its frame while an associated guide and foot may be moveable. In some embodiments, a foot may be fixed in relation to its frame while an associated guide and probe may be moveable. At least one of a probe, a guide, and a foot is moveably connected to a frame according to some embodiments. For example, either a probe is fixedly connected to a frame or a foot is fixedly connected to a frame. At least one of a probe and a foot is moveably connected to a frame. According to some embodiments, either a guide or a foot is fixedly connected to a frame. At least one of a guide and a foot is moveably connected to a frame.

A frame, probe, guide, and foot may be positioned relative to one another as desired and/or required to move rolls having a selected size and/or range of sizes. In some embodiments, a lift assembly may be configured to move rolls with contact points limited to a probe, a guide, and/or a foot, for example, substantially without rolls contacting the frame. A lift assembly may be configured to move rolls with some contact occurring between rolls and the frame (e.g., for supplemental stabilization).

In some embodiments, a lift assembly may comprise a probe mount linking a frame and a probe. A probe mount may serve as a fixed mount, an adjustable mount, a lockable mount, and/or a moveable mount linking a probe to a frame. A probe mount may comprise one or more controllers, fixed connectors, moveable connectors, pistons, levers, motors, gears, and the like to facilitate its selected function (e.g., allowing or not allowing movement of the probe relative to the frame).

A lift assembly may comprise, according to some embodiments, a foot mount linking a frame and a foot. A probe mount may serve as a fixed mount, an adjustable mount, a lockable mount, and/or a moveable mount linking a foot to a frame. A probe mount may comprise one or more controllers, fixed connectors, moveable connectors, pistons, levers, motors, gears, and the like to facilitate its selected function (e.g., allowing or not allowing movement of the foot relative to the frame).

A lift assembly may comprise a guide linked to a frame directly or via a guide mount, in some embodiments. A guide mount may serve as a fixed mount, an adjustable mount, a lockable mount, and/or a moveable mount linking a guide to a frame. A guide mount may comprise one or more controllers, fixed connectors, moveable connectors, pistons, levers, motors, gears, and the like to facilitate its selected function (e.g., allowing or not allowing movement of the guide relative to the frame).

A lift assembly may be operably linked to a gantry, crane or other translocation apparatus to facilitate movement of the lift assembly (e.g., laden and/or unladen with rolls) over a distance. A lift assembly may be linked to a translocation apparatus by any suitable means. In some embodiments, a lift assembly may be connected to a translocation apparatus via its frame, frame mount, and/or probe mount.

Apparatus and systems of the disclosure may be configured to accept any type of roll or rolled material. Likewise, methods may be selected and/or adapted as needed to maneuver any type of roll or rolled material. Rolls may have a generally cylindrical shape defining a longitudinal axis about which roll material is positioned (e.g., rolled, spun, wrapped, wound). A roll may have a core that is at least partially hollow. For example, a roll may have a core that is hollow near one end defining an aperture sized to receive a lifting apparatus probe. A lifting apparatus may be configured to keep a roll vertical or substantially vertical. Verticality may be assessed with respect to a longitudinal axis of a roll. Some embodiments are illustrated herein with respect to palletizing modified bitmus rolls, but applicability to other rolled materials will be appreciated by artisans of ordinary skill having the benefit of the present disclosure.

The present disclosure relates, in some embodiments, to methods for maneuvering a roll (e.g., a roll of material) using a lift assembly. For example, a method may include positioning a lift assembly near a roll, inserting a probe into an end aperture of the roll, extending a foot under a portion of the roll opposite the end aperture into which the probe is inserted, moving the roll as desired, extending a guide to contact at least a portion of the circumference of the roll, retracting the foot, and/or disengaging the probe from the end aperture. A lift assembly may be positioned using any desired apparatus including, for example, a robot, a motor, a gantry, and/or combinations thereof. A probe may be inserted into a roll by moving the lift assembly, moving the probe, or combinations thereof. A probe may be configured to prevent the roll from tipping, for example, when being lifted and transferred to a pallet. A foot may be actuated (e.g., extended) by a hydraulic and/or pneumatic cylinder. Once a foot is in place, a roll may be moved (e.g., lifted, lowered, translocated, transferred, rotated, and combinations thereof) to a desired position. Depositing a roll in a desired position may include positioning a lift assembly holding the roll over the desired position (e.g., about one inch over), extending a guide (e.g., a kick plate) to contact (e.g., slightly contact) the roll (e.g., the bottom quarter of the roll), retracting a foot permitting the roll to drop (e.g., gently dropped) onto the desired position. A guide (e.g., kick plate) may prevent the bottom of the roll from kicking out by friction from the retracting foot plate. A robot may move an assembly away from a palletizing area and the sequence optionally may be repeated. In some embodiments, a method may permit rolls to be palletized safely and without damage.

In some embodiments, a roll may be deposited in a desired location without or substantially without damage (e.g., surface abrading). Abrading (e.g., from sliding across a kick plate) may be reduced, minimized, or eliminated, according to some embodiments. For example, simply minimizing the drop distance may be sufficient to achieve the desired reduction. In some cases, it may be desirable to use a guide that includes a low-friction surface or surface coating. A desired reduction in abrading may be achieved using a guide that includes one or more rollers in, on, or as, its contact surface. In some embodiments, some abrading on the surface of a roll may be tolerated.

According to some embodiments, a roll may be deposited in a desired location without or substantially without any freefall and/or without or substantially without movement across the guide. For example, a roll on a lift assembly may be tilted such that an edge (e.g., a distal edge) contacts the desired deposit point. A foot may then be withdrawn (e.g., in a direction generally opposite the contact point and/or generally toward the guide). A roll may be concurrently returned to an upright position, for example by translation of the probe as needed or allowed to return to an upright position by simply withdrawing the probe. Once a foot and probe are withdrawn from a roll, a lift assembly may be moved away from the roll and reset for another cycle.

Figure 1B:
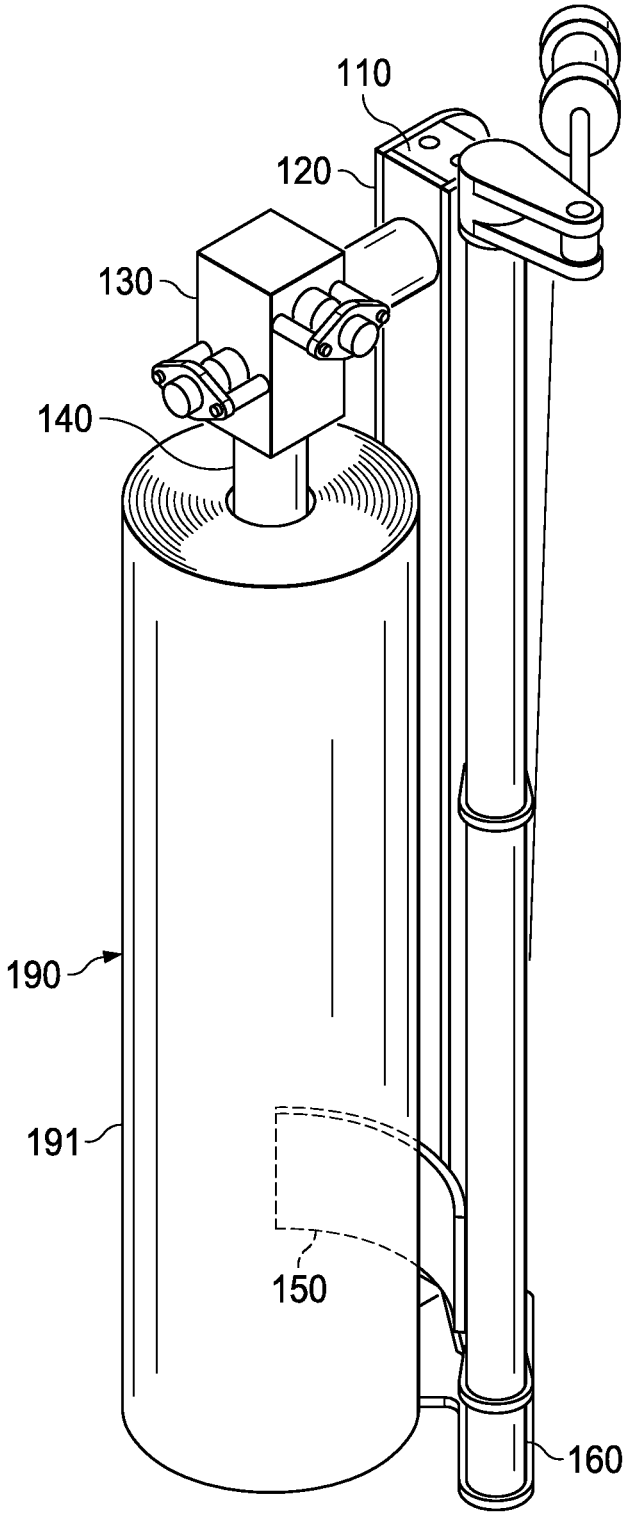
FIG. 1B illustrates a perspective view of a roll lifting apparatus engaging a roll according to a specific example embodiment of the disclosure.
Figure 1C:
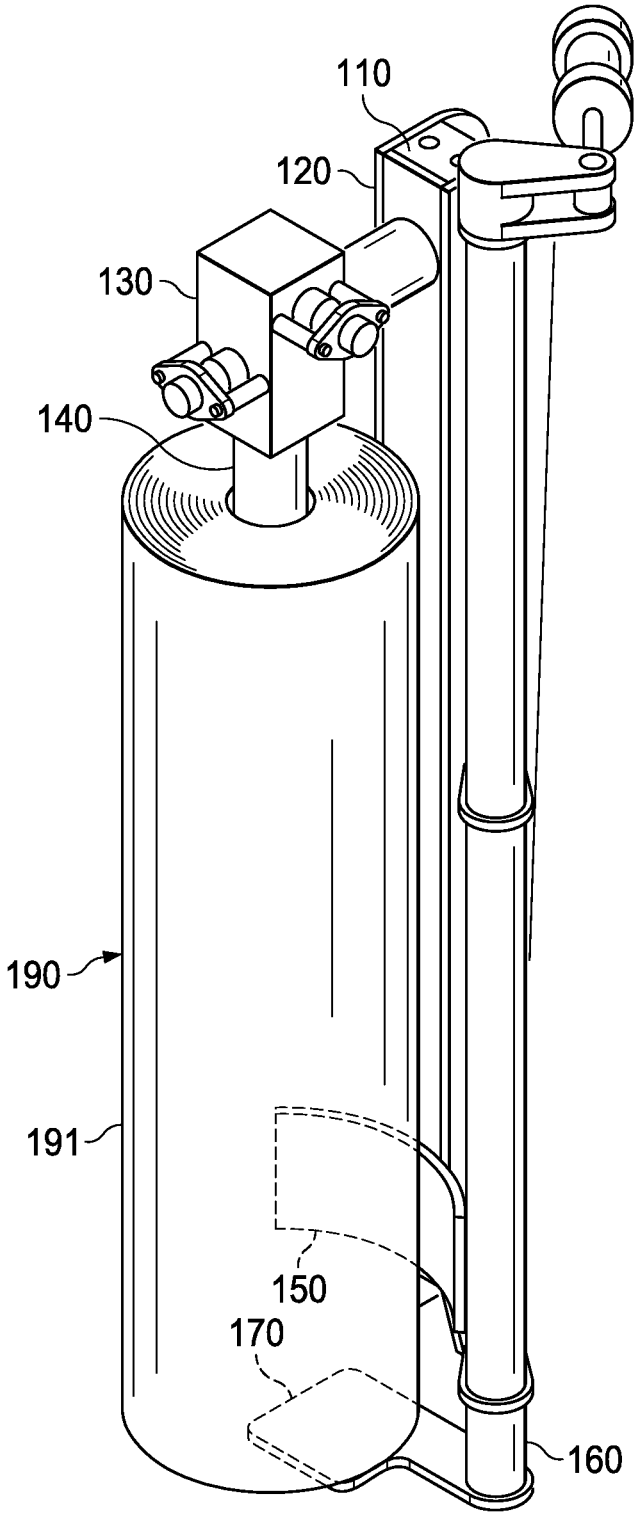
FIG. 1C illustrates a perspective view of a roll lifting apparatus further engaging a roll according to a specific example embodiment of the disclosure.
Figure 1D:
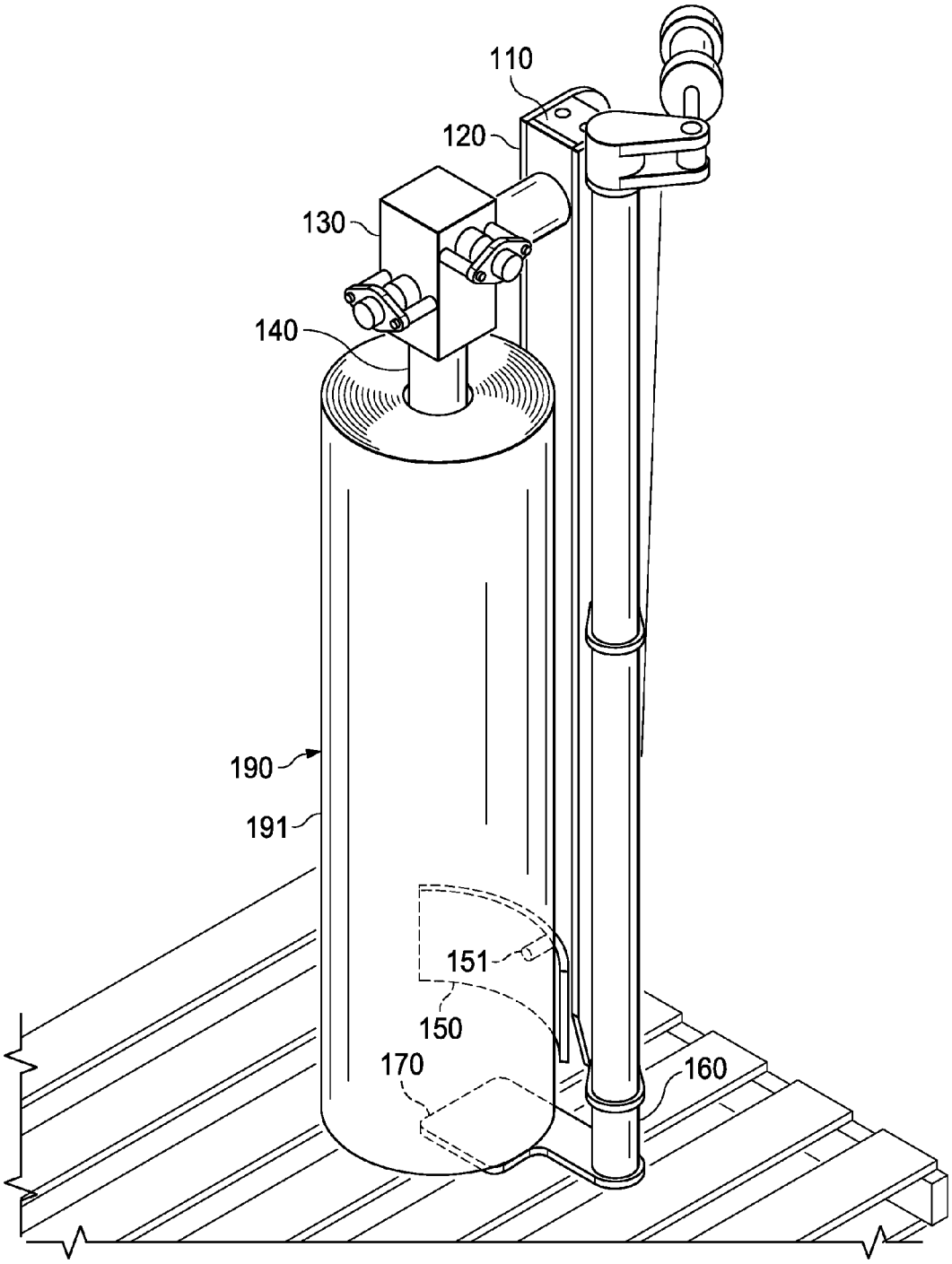
FIG. 1D illustrates a perspective view of a roll lifting apparatus further engaging a roll according to a specific example embodiment of the disclosure.
Figure 1E:
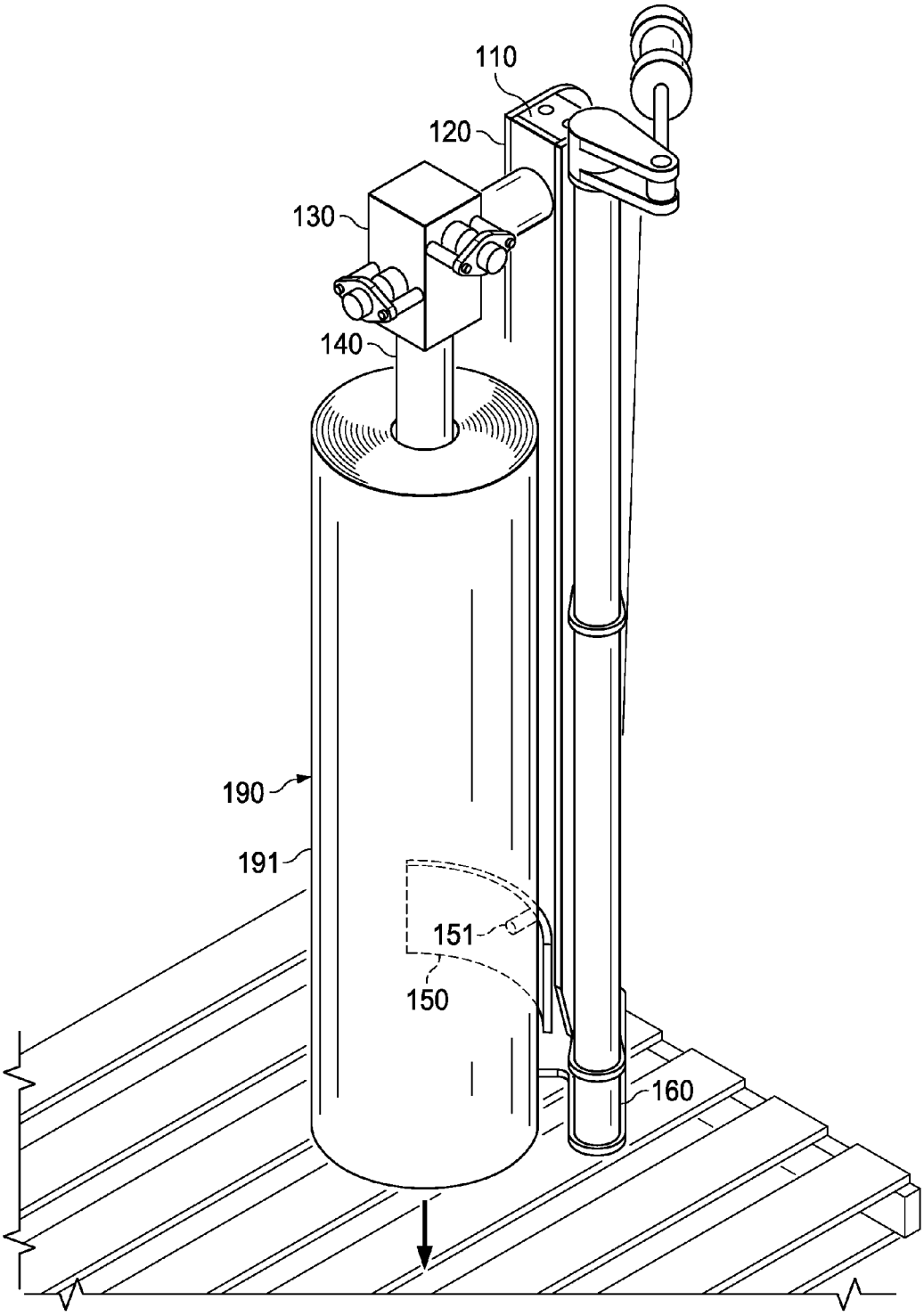
FIG. 1E illustrates a perspective view of a roll lifting apparatus releasing a roll according to a specific example embodiment of the disclosure.

Specific example embodiments of a lift assembly are illustrated in FIGS. 1A-1F. Lift assembly 105 comprises frame mount 110, frame 120, probe mount 130, probe 140, guide 150, foot mount 160, and foot 170. As shown, frame 120 is connected to frame mount 120, probe mount 130, guide 150, and foot mount 160. In operation, lift assembly 105 is lowered on to roll 190 (FIG. 1A) such that probe 140 is inserted into aperture 192 (FIG. 1B). With probe 140 in position, foot 170 may be extended from (e.g., rotated about) foot mount 160 under roll 190 (FIG. 1C). Guide 150 may be extended via arm 151 to touch roll body 191 (FIG. 1D). With roll 190 secured (either before or after extension of guide 150), lift assembly 105 may be moved as desired. Once roll 190 is positioned above its desired deposit point, foot 170 may be withdrawn (e.g., rotated about mount 160) (FIG. 1E). Probe 140 may be positioned, guide 150 may be positioned, and/or foot 170 may be withdrawn such that roll 190 does not or substantially does not tip as foot 170 moves. Once foot 170 is clear, roll 190 may move, fall, or slide to its deposit point.

The extent to which probe 140 may be inserted into aperture 192 may be related to the height above an intended deposit point. For example, if roll 190 is to be released about 1 inch from an intended deposit point, probe 140 may be inserted into aperture 192 to an extent sufficient (i.e., at least one inch) to remain at least partially within aperture 192 after roll 190 traverses the one inch distance and comes to rest on the intended deposit point. This may allow a lift assembly to ensure that a deposited roll is stable before disengaging a probe.

According to some embodiments, probe 140 may be fixed to probe mount 130 at its proximal end and have a body that is generally cylindrically-shaped with a rounded or domed portion at its distal end. Probe 140 may be configured as a static probe or an expandable probe. A static probe may be sized to fit aperture 192 (e.g., with substantially the same or a slightly smaller radius than aperture 192). Probe 140 may be configured to stabilize roll 190 in a generally vertical position. Probe 140 may be configured to bear little or none of the weight of roll 190 in some embodiments. Probe 140 may be configured, in some embodiments, to bear at least a portion of the weight of roll 190. Probe 140 may be configured to bear up to, but not including, the entire weight of roll 190. Probe 140 may be dimensioned to limit or prevent movement of the distal end of roll 190, for example, to guard against roll 190 slipping off foot 170 (e.g., if roll 190 is tipped or bumped).

Figure 2A:
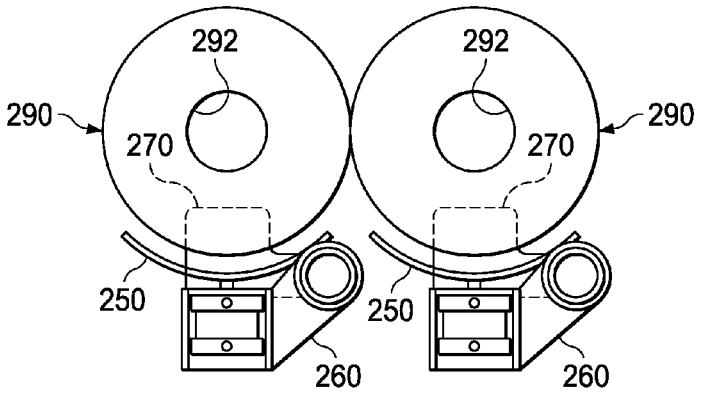
FIG. 2A illustrates a top view of a roll lifting apparatus engaging a roll according to a specific example embodiment of the disclosure.
Figure 2B:
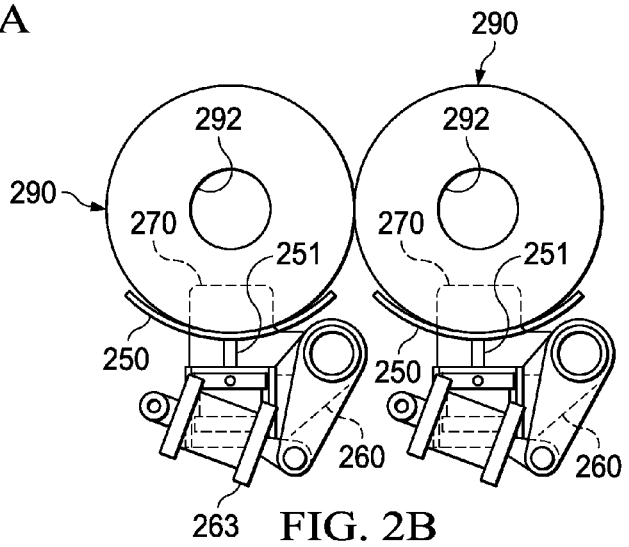
FIG. 2B illustrates a top view of a roll lifting apparatus further engaging a roll according to a specific example embodiment of the disclosure.
Figure 2C:
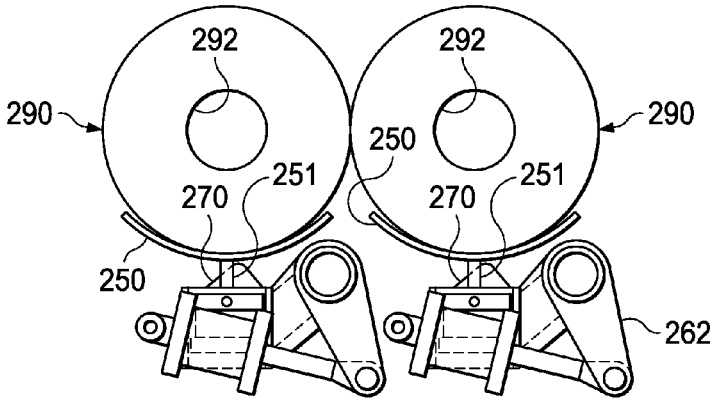
FIG. 2C illustrates a top view of a roll lifting apparatus releasing a roll according to a specific example embodiment of the disclosure.
Figure 2D:
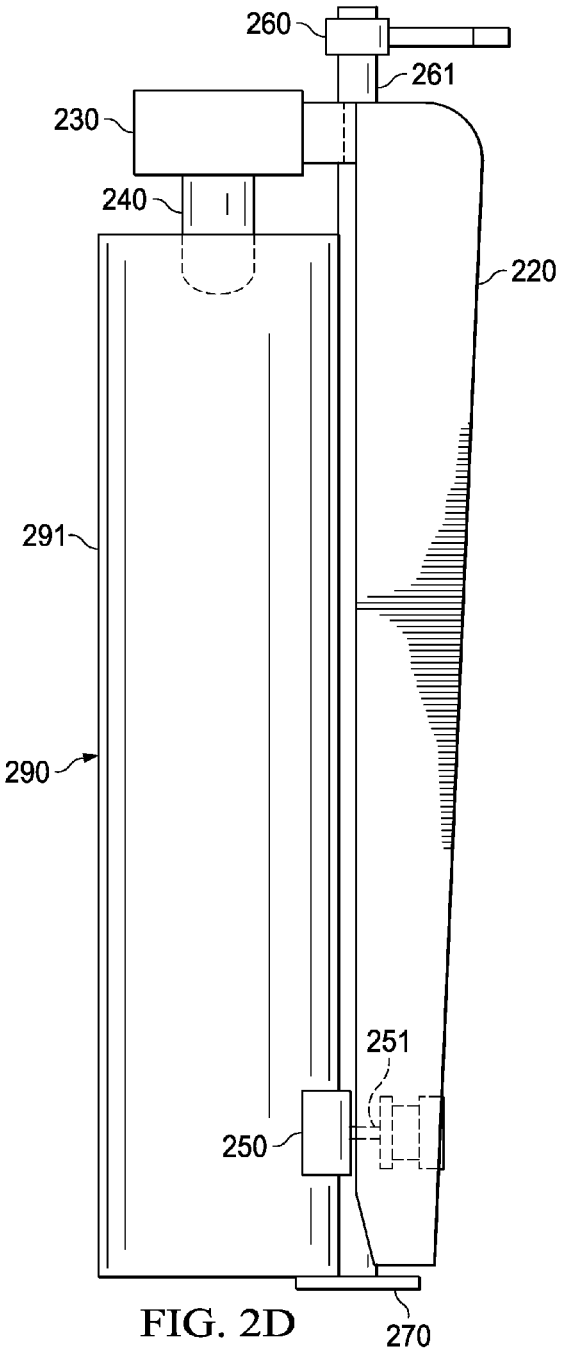
FIG. 2D illustrates a profile view of a roll lifting apparatus engaged with a roll according to a specific example embodiment of the disclosure.
Figure 2E:
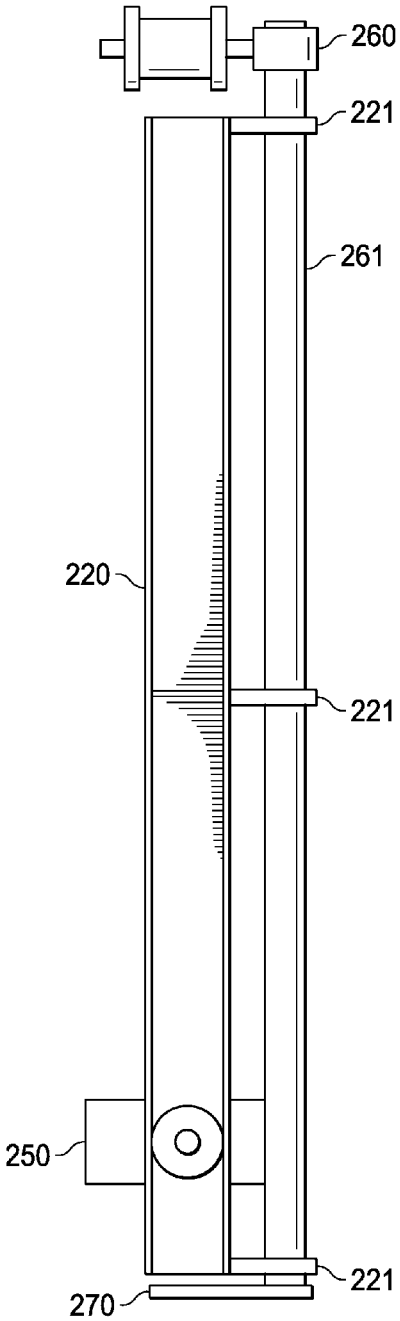
FIG. 2E illustrates a rear view of a roll lifting apparatus according to a specific example embodiment of the disclosure.

Specific example embodiments of a lift assembly are illustrated in FIGS. 2A-2E. Lift assembly 205 comprises frame 220 and dual probe mounts 230, probes 240, guides 250, arms 251, foot mounts 260, and feet 270 to accommodate dual rolls 290. Foot mounts 260 each comprise vertical connector 261, lateral connector 262, and piston 263 wherein contraction of piston 263 laterally translates connector 262, which in turn counter rotates connector 261. Counter rotation of connector 261 translates foot 270 away from frame 220 and under roll 290. Expansion of piston 263 laterally translates connector 262, which in turn rotates connector 261. Rotation of connector 261 translates foot 270 toward frame 220 and away from roll 290. FIG. 2A illustrates lift assembly 205 loaded with rolls 290. Prior to offloading rolls 290, arms 251 extend guides 250 into gentle contact with roll bodies 291 (FIG. 2B). Pistons 263 expand, translating connectors 262, counter rotating connectors 261 thereby sliding feet 270 out from under rolls 290 (FIG. 2C). As shown, guide 250 may be shaped to generally follow the contour of roll body 290. Pistons 263 may be fixedly attached to frame 220. Pistons 263 may be actuated hydraulically and/or pneumatically.

Figure 3A:
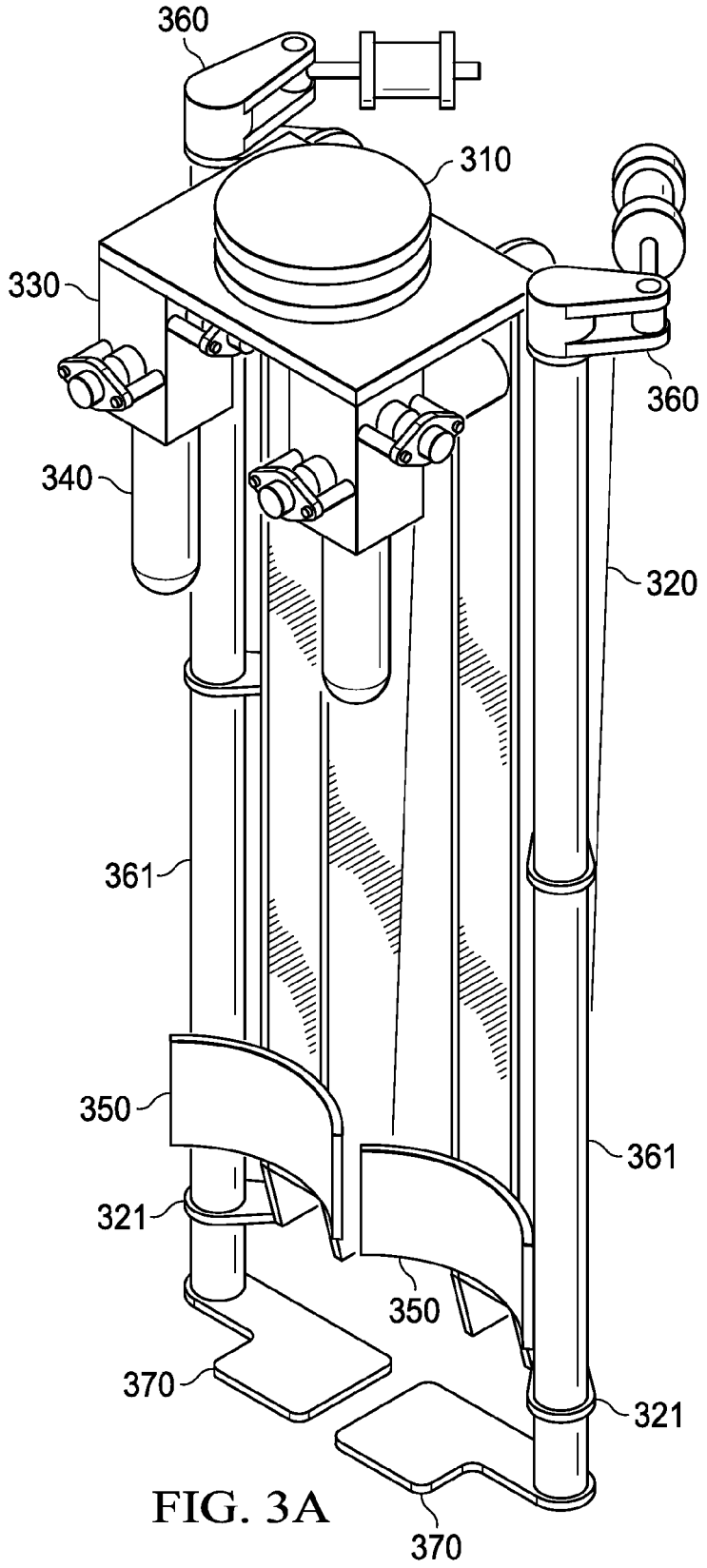
FIG. 3A illustrates a front perspective view of a roll lifting apparatus according to a specific example embodiment of the disclosure.
Figure 3B:
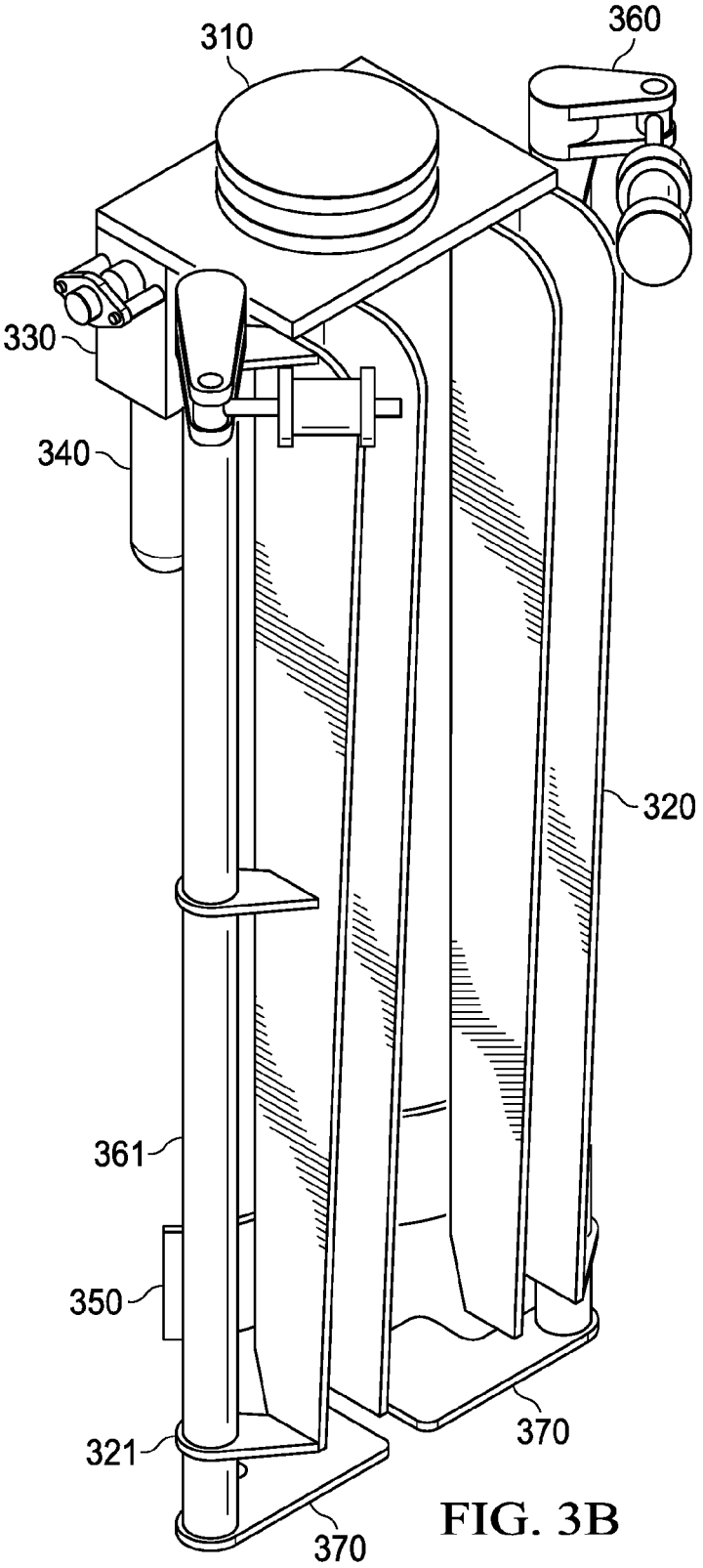
FIG. 3B illustrates a rear perspective view of a roll lifting apparatus according to a specific example embodiment of the disclosure.

Specific example embodiments of a lift assembly are illustrated in FIGS. 3A-3B. Lift assembly 305 comprises frame 320 and dual probe mounts 330, probes 340, guides 350, arms 351, foot mounts 360, and feet 370 to accommodate dual rolls 390. Frame 320 has a vertically oriented, generally elongated structure. Portions 322 of frame 320 lie in a plane substantially parallel to the plane defined by the longitudinal axes of the rolls to be lifted. Portions 323 of frame 320 are substantially perpendicular to and behind portions 322, which permits them to reinforce frame 320. Fixed at its upper end is probe mount 330 comprising slides 331 and 332 for lateral translation of probe 340. Vertical movement of probes 340 may be accomplished by vertically moving lift 305. Probes 340 have rounded tips and a generally half-cylinder shape along a vertical plane with the rounded cylinder portion facing frame 320. Foot mounts 360, as shown, extend along the length of frame 320 with connector 362 and piston 363 positioned at the top of frame 320 and connector 361 extending from top to bottom of frame 320. Bosses 321 extend laterally outward from the core of frame 320 and hold or confine vertical connectors 361 to rotational movement. Guides 350 are connected to frame 320 by extendible/retractable arms 351. Guides 350 are illustrated with a curvature directed generally away from frame 320 and towards roll 390. Foot mounts 360 each comprise vertical connector 361, lateral connector 362, and piston 363 wherein movement of pistons 363 results in movement of feet 370 like lift assembly 205.

Figure 4A:
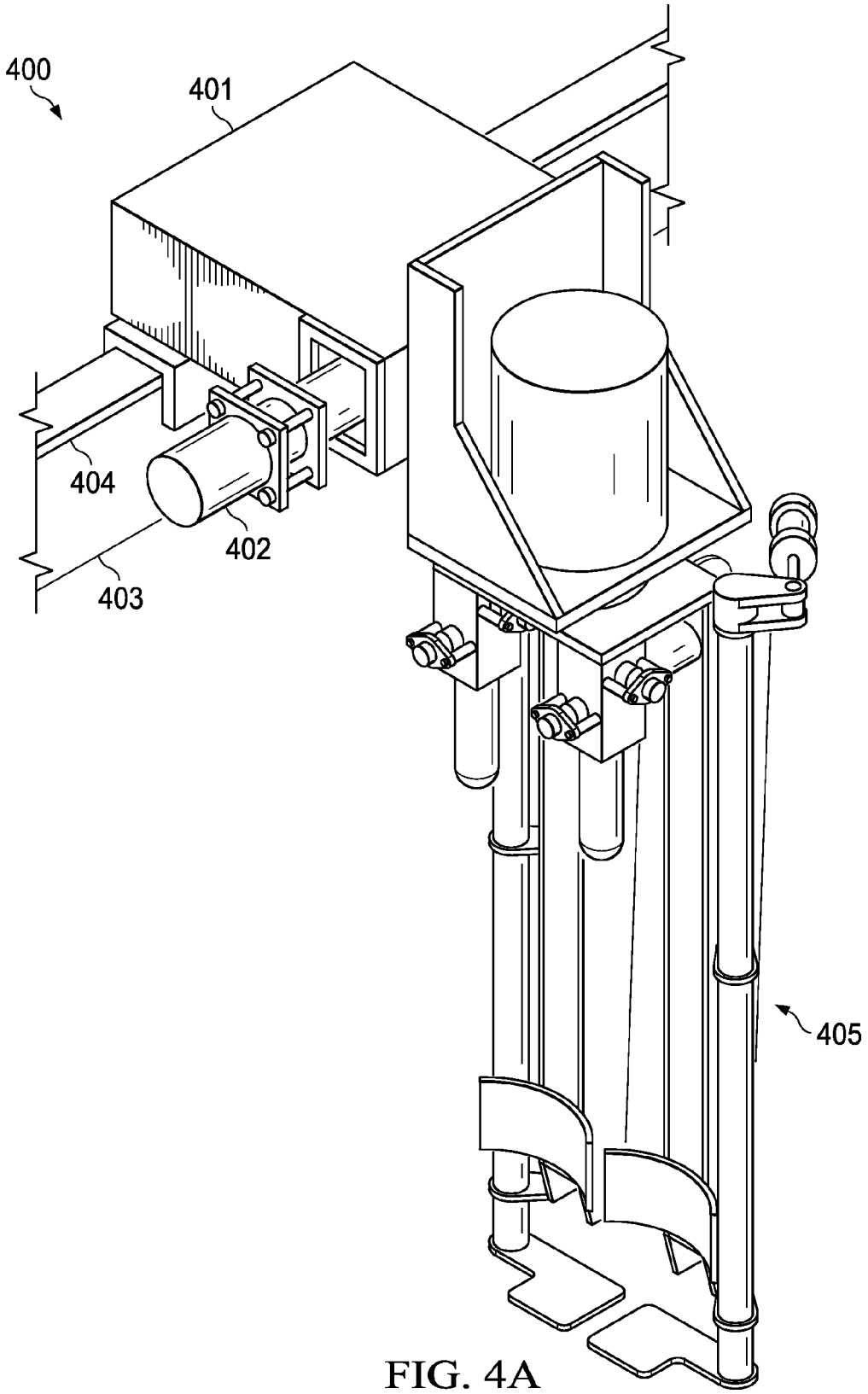
FIG. 4A illustrates a front perspective view of a roll lifting system according to a specific example embodiment of the disclosure.
Figure 4B:
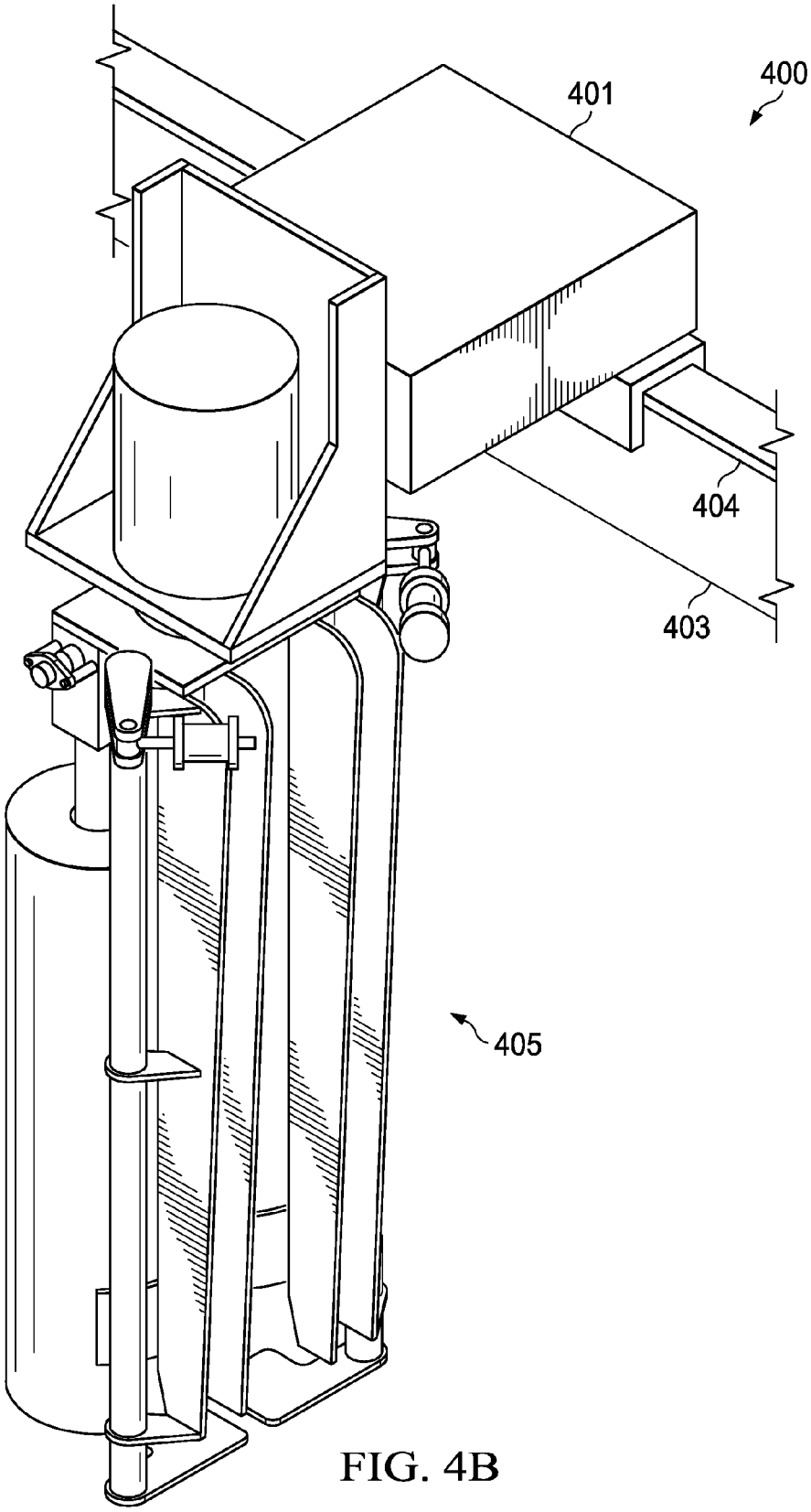
FIG. 4B illustrates a rear perspective view of a roll lifting system according to a specific example embodiment of the disclosure.

Specific example embodiments of a lift system are illustrated in FIGS. 4A-4B. Lift system 400 comprises gantry 401 and roll lifting assembly 405. Gantry 401, as shown, comprises motor 402, arm 403, and beam 404. Lift assembly 405, as shown, is mounted to and extends from gantry arm 403. Motor 402 is operably coupled to gantry arm 403 and lift assembly 405 to raise and lower lift assembly 405. Gantry arm 403 and beam 404 are operably linked to move lift assembly 405 laterally in two dimensions. For example, beam 404 may be fixed with respect to the surrounding environment and arm 403 may be positioned generally perpendicular to the length of beam 404. Arm 403 may move along the length of beam 404, transverse to the length of beam 404, or any combination thereof. Motor 402 and/or a separate motor may be configured to ambulate arm 403.

In some embodiments, a lifting assembly may be used in combination with an upender. For example, an upender may position a roll in a vertical position. A lifting assembly may be configured to receive a vertical roll, for example, with a portion (e.g., about 50%) of its diameter supported by the upender's standing plate and a portion (e.g., the remaining portion) overhanging. A foot may be extended under a roll on an upender beneath the overhanging section, for example, where it may be desirable to minimize any risk of abrading the supported portion.

As will be understood by those skilled in the art who have the benefit of the instant disclosure, other equivalent or alternative compositions, devices, methods, and systems for moving a roll can be envisioned without departing from the description contained herein. Accordingly, the manner of carrying out the disclosure as shown and described is to be construed as illustrative only.

Persons skilled in the art may make various changes in the shape, size, number, and/or arrangement of parts without departing from the scope of the instant disclosure. For example, the size, position and number of frames, probes, guides, feet, and/or mounts may be varied. In addition, the size of a lift assembly and/or system may be scaled up or down to suit the needs and/or desires of a practitioner and/or to accommodate rolls of various sizes. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a composition, device, and/or system of the disclosure.

All or a portion of a device and/or system for moving a roll may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. A roll lifting system comprising:

a translocation apparatus comprising:

a fixed beam having a longitudinal axis; and an arm having a longitudinal axis and operable to move relative to the beam in a plane defined by the longitudinal axes of the beam and the arm; and a lift assembly mounted to the translocation apparatus at a first end of the arm, the lift assembly comprising:

a generally elongated frame having an upper end and a lower end and side by side first and second portions;

a first probe moveably connected at the upper end of the first portion of the frame;

a first pivot point moveably connected at the lower end of the first portion of the frame;

a first foot moveably connected at the first pivot point;

a first guide moveably connected at a first portion of the frame between its upper end and its lower end;

a second probe moveably connected at the upper end of the second portion of the frame;

a second pivot point moveably connected at the lower end of the second portion of the frame;

a second foot moveably connected at the second pivot point; and a second guide moveably connected at a second portion of the frame between its upper end and its lower end;

wherein the first probe, foot, and guide are configured to contact a first roll and the first foot is configured to bear more than half of the weight of the first roll, and wherein the second probe, foot, and guide are configured to contact a second roll and the second foot is configured to bear more than half the weight of the second roll.

2. A system according to claim 1, wherein the first foot is configured to bear substantially all of the weight of the first roll and the second foot is configured to bear substantially all of the weight of the second roll.

3. A system according to claim 1, wherein the first roll has a hollow core, the first probe is configured for insertion into at least a portion of the hollow core of the first roll, the second roll has a hollow core, and the second probe is configured for insertion into at least a portion of the hollow core of the second roll.

4. A system according to claim 1, wherein the first roll has an upper end and a lower end, the first foot is configured to reversibly slide under a portion of the lower end of the first roll, the second roll has an upper end and a lower end, and the second foot is configured to reversibly slide under a portion of the lower end of the second roll.

5. A system according to claim 1, wherein the first guide is configured to contact the lower third of the first roll, and the second guide is configured to contact the lower third of the second roll.

6. A system according to claim 1, wherein the lift assembly is configured to receive each of the first roll and the second roll in a substantially vertical position.

7. A system according to claim 1, wherein the lift assembly is configured to maintain each of the first roll and the second roll in a substantially vertical position throughout translocation.

8. A method for moving vertically standing rolls with a lift system comprising:

a translocation apparatus comprising:

a fixed beam having a longitudinal axis; and an arm having a longitudinal axis and operable to move relative to the beam in a plane defined by the longitudinal axes of the beam and the arm; and a lift assembly mounted to the translocation apparatus at a first end of the arm, the lift assembly comprising:

a generally elongated frame having an upper end and a lower end and side by side first and second portions;

a first probe moveably connected at the upper end of the first portion of the frame;

a first pivot point moveably connected at the lower end of the first portion of the frame;

a first foot moveably connected at the first pivot point;

a first guide moveably connected at a first portion of the frame between its upper end and its lower end;

a second probe moveably connected at the upper end of the second portion of the frame;

a second pivot point moveably connected at the lower end of the second portion of the frame;

a second foot moveably connected at the second pivot point; and a second guide moveably connected at a second portion of the frame between its upper end and its lower end;

wherein the first probe, foot, and guide are configured to contact a first roll having a first end, a second end, and a hollow core, and the first foot is configured to bear more than half of the weight of the first roll, and wherein the second probe, foot, and guide are configured to contact a second roll having a first end, a second end, and a hollow core, and the second foot is configured to bear more than half the weight of the second roll, the method comprising:

contacting at least a portion of the first probe with at least a portion of the hollow core nearest the upper end of the first roll;

contacting at least a portion of the second probe with at least a portion of the hollow core nearest the upper end of the second roll;

contacting at least a portion of the first foot with at least a portion of the lower end of the first roll;

contacting at least a portion of the second foot with at least a portion of the lower end of the second roll;

ambulating the lift assembly from a first position to a second position via the translocation apparatus;

contacting at least a portion of the first guide with at least a portion of the first roll;

contacting at least a portion of the second guide with at least a portion of the second roll;

disengaging the first foot from the lower end of the first roll;

disengaging the second foot from the lower end of the second roll;

disengaging the first probe from the upper end of the first roll; and disengaging the second probe from the upper end of the second roll.

9. A method according to claim 8, wherein the first roll and the second roll are continuously or substantially continuously maintained in a generally vertical position.

10. A method according to claim 8, wherein disengaging the first probe from the upper end of the first roll further comprises partially disengaging the first probe from the upper end of the first roll, confirming the first roll is at rest in a generally vertical position, and completing disengagement of the first probe from the upper end of the first roll.

11. A method according to claim 8, wherein disengaging the second probe from the upper end of the second roll further comprises partially disengaging the second probe from the upper end of the second roll, confirming the second roll is at rest in a generally vertical position, and completing disengagement of the second probe from the upper end of the second roll.

12. A method according to claim 8, wherein ambulating the lift assembly from a first position to a second position via the translocation apparatus further comprises suspending the first roll and the second roll no more than about one inch above the second position.

13. A method according to claim 12, wherein the first roll moves downward no more than about one inch upon disengaging the first foot and the second roll moves downward no more than about one inch upon disengaging the second foot.

14. A method according to claim 8, wherein the first roll remains in substantially the same condition in the second position as it had in the first position and the second roll remains in substantially the same condition in the second position as it had in the first position.

15. A roll lifting assembly comprising:

a generally elongated frame having an upper end and a lower end and side by side first and second portions;

a first probe moveably connected at the upper end of the first portion of the frame;

a first pivot point moveably connected at the lower end of the first portion of the frame;

a first foot moveably connected at the first pivot point;

a first guide moveably connected at a first portion of the frame between its upper end and its lower end;

a second probe moveably connected at the upper end of the second portion of the frame;

a second pivot point moveably connected at the lower end of the second portion of the frame;

a second foot moveably connected at the second pivot point; and a second guide moveably connected at a second portion of the frame between its upper end and its lower end;

wherein the first probe, foot, and guide are configured to contact a first roll and the first foot is configured to bear more than half of the weight of the first roll, and wherein the second probe, foot, and guide are configured to contact a second roll and the second foot is configured to bear more than half the weight of the second roll.

16. An assembly according to claim 15, wherein the first foot is configured to bear substantially all of the weight of the first roll and the second foot is configured to bear substantially all of the weight of the second roll.

17. An assembly according to claim 15, wherein the first roll has a hollow core, the first probe is configured for insertion into at least a portion of the hollow core of the first roll, the second roll has a hollow core, and the second probe is configured for insertion into at least a portion of the hollow core of the second roll.

18. An assembly according to claim 15, wherein the first roll has an upper end and a lower end, the first foot is configured to reversibly slide under a portion of the lower end of the first roll, the second roll has an upper end and a lower end, and the second foot is configured to reversibly slide under a portion of the lower end of the second roll.

19. An assembly according to claim 15, wherein the first guide is configured to contact the lower third of the first roll, and the second guide is configured to contact the lower third of the second roll.

20. An assembly according to claim 15, wherein the assembly is configured to receive and maintain each of the first roll and the second roll in a substantially vertical position throughout translocation.

* * * * *